United States Patent [19]

Longo

[11] 4,129,329

[45] Dec. 12, 1978

[54] SELF-POWERED BUCKET ARRANGEMENT

[75] Inventor: Joseph F. Longo, Wilton, Conn.

[73] Assignee: International Dynetics Corporation, South Norwalk, Conn.

[21] Appl. No.: 775,207

[22] Filed: Mar. 7, 1977

[51] Int. Cl.[2] ..... B66C 3/02

[52] U.S. Cl. ..... 294/70; 37/187; 294/88

[58] Field of Search ..... 294/66 R, 66 A, 70, 294/71, 88, 106; 37/56, 71, 182–188; 214/147 R, 147 G, 656–658

[56] References Cited

U.S. PATENT DOCUMENTS

| | | | |
|---|---|---|---|
| 2,889,642 | 6/1959 | Stein | 37/71 UX |
| 3,061,957 | 11/1962 | Fehlmann | 214/656 X |
| 3,194,329 | 7/1965 | Wallers | 37/182 X |
| 3,310,335 | 3/1967 | Shuey | 294/88 |
| 3,774,954 | 11/1973 | Taguchi et al. | 294/70 |

FOREIGN PATENT DOCUMENTS

| | | | |
|---|---|---|---|
| 1327125 | 4/1963 | France | 294/88 |
| 1347075 | 11/1963 | France | 294/70 |
| 1376253 | 9/1964 | France | 37/186 |
| 347472 | 4/1931 | United Kingdom | 37/186 |
| 920977 | 3/1963 | United Kingdom | 294/88 |
| 1214763 | 12/1970 | United Kingdom | 37/186 |

*Primary Examiner*—Johnny D. Cherry

[57] ABSTRACT

A pair of bucket bowls are pivotally suspended from a power head frame in which is mounted two pairs of hydraulic rams. Each of the hydraulic rams has one end pivotally connected to the power head frame and another end pivotally connected to a bucket bowl. The power head frame houses power components in specially designed compartments so as to achieve a symmetrical configuration to balance the forces acting on the bucket bowls.

9 Claims, 4 Drawing Figures

SELF-POWERED BUCKET ARRANGEMENT

BACKGROUND OF THE INVENTION

The present invention is directed to an electro-hydraulic bucket arrangement for material handling, and especially for digging and the transport of the dug-up material to another location.

Bucket arrangements are well-known and typically fall into the class of mechanical buckets where two bucket bowls are pivotal toward and away from each other to gather material and transport it to a desired area. However, all of these prior bucket arrangements have been complicated and difficult to maintain due to the many movable parts making up the arrangement.

SUMMARY OF THE INVENTION

It is, therefore, the primary object of the present invention to provide a bucket arrangement that is easily serviceable and consistent in operation. To this end, the bucket arrangement of the present invention is provided with a head area that mounts the entire power unit for pivotting the bucket bowls toward and away from each other, such power unit consisting of two pairs of hydraulic rams having one end connected to the bucket bowls, an electric motor, an hydraulic pump driven by the electric motor, a flow divider, and a hydraulic control valve. All the components of the power unit are housed in the power head frame of the bucket arrangement and are easily accessible by simple removal of the shelf on which the components are mounted.

The bucket arrangement of the present invention is self-powered and requires only a single-drum crane and an electric wire, rather than a two-drum crane required by the arrangements of the prior art. Further, due to the simplified design of the arrangement, a large number of pivot bearings, pins, sheaves, and levers are not necessary; the present invention using only two large pivot bearings and pins, thereby greatly reducing the maintenance reqiured.

BRIEF DESCRIPTION OF THE DRAWING

The invention will be more readily understood with reference to the following detailed description when taken in conjunction with the accompanying drawings, wherein.

DETAILED DESCRIPTION OF THE INVENTION

Figure 2:
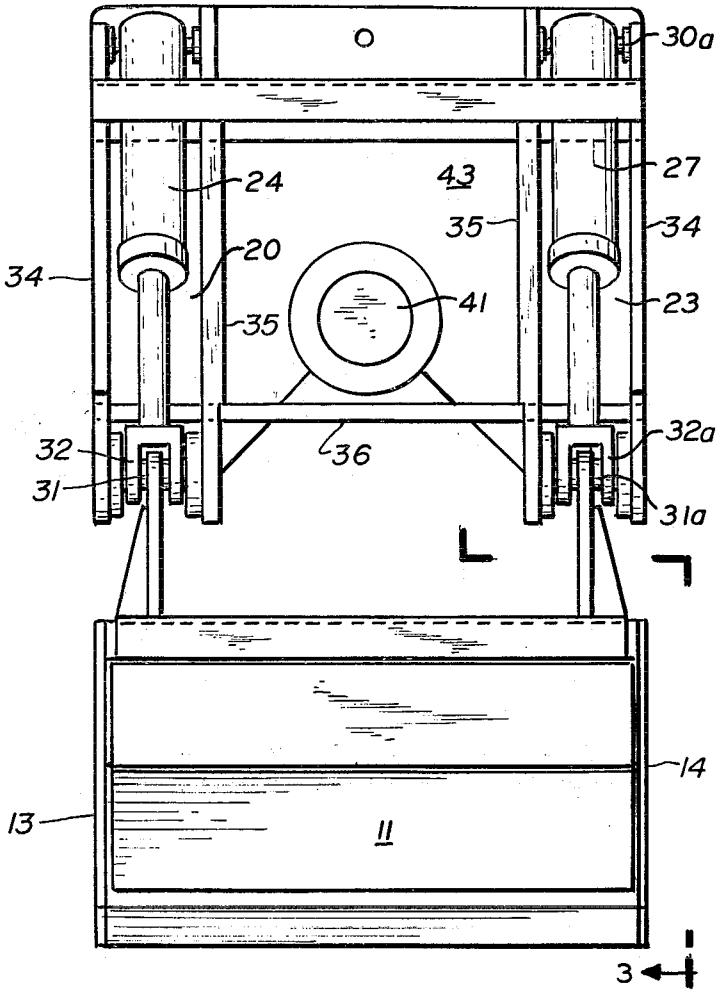
FIG. 2 is an end view of the bucket arrangement of FIG. 1.
Figure 1:
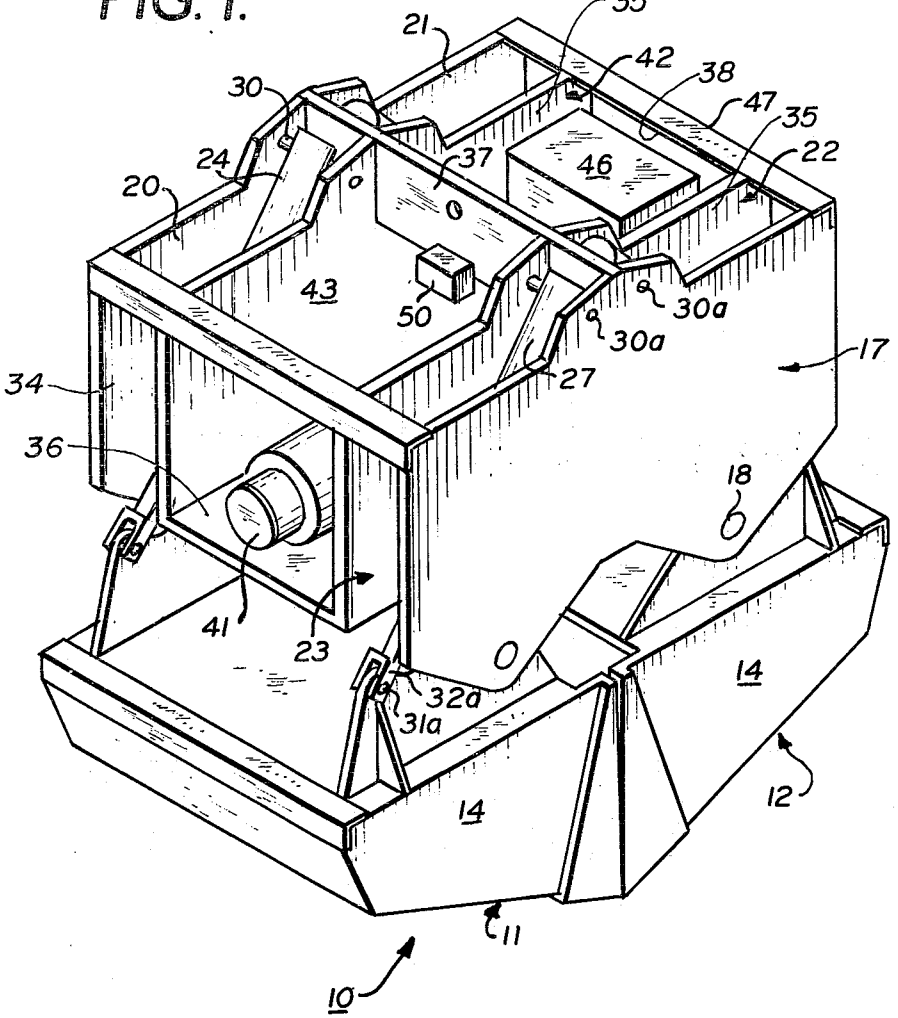
FIG. 1 is a perspective view showing the bucket arrangement of the present invention.
Figure 3:
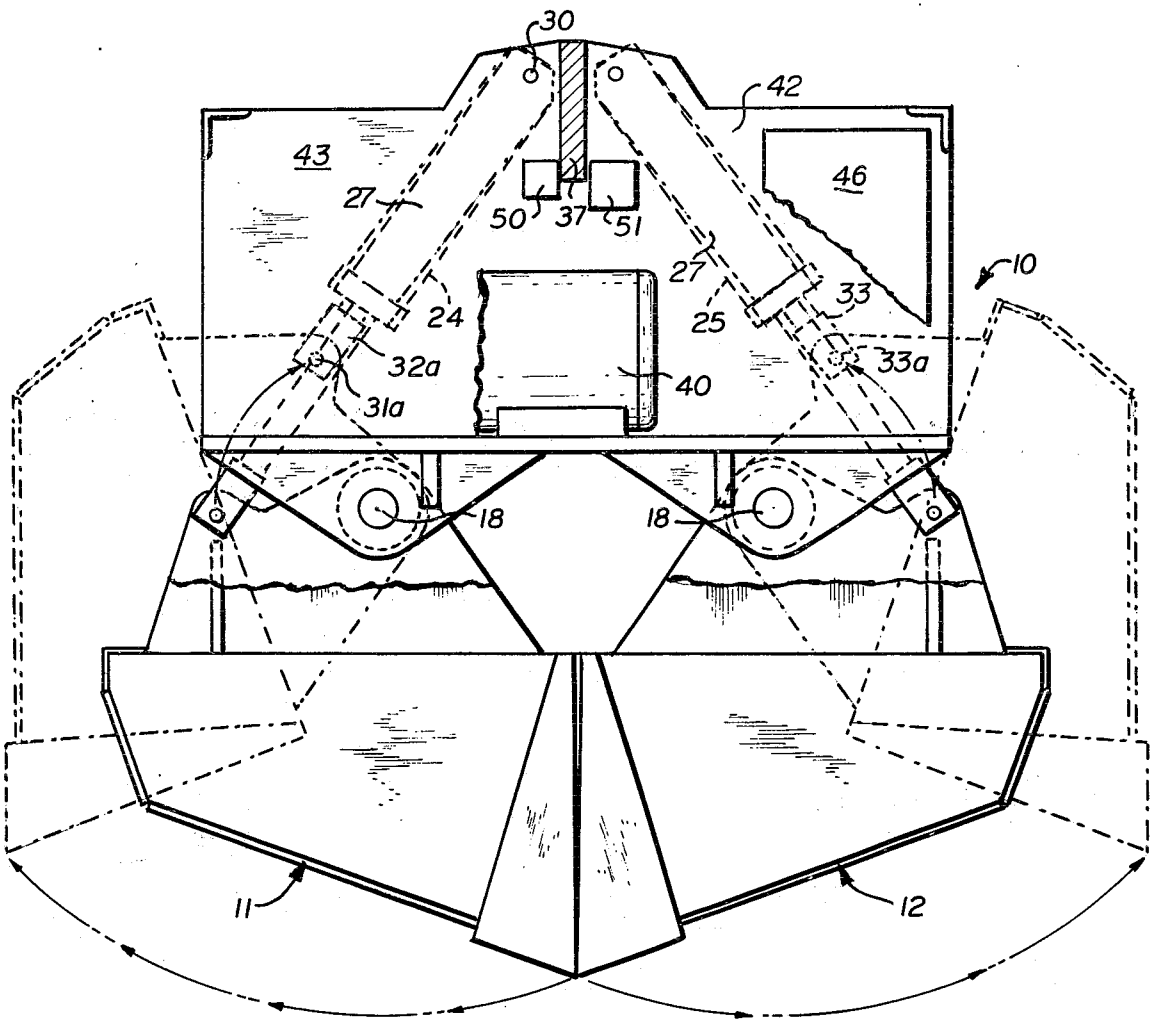
FIG. 3 is a side elevational view of the bucket arrangement shown in FIGS. 1 and 2, taken along line 3-3 of FIG. 1.

Referring now to the drawings, the bucket arrangement 10 of the invention is shown in FIGS. 1 – 3. The bucket arrangement has two conventional bucket bowls 11 and 12, each having two parallely spaced blade arms 13 and 14, respectively. The bucket bowls are pivotally connected to a power head frame 17 by four pins 18 pivotally mounting the four blade arms.

The power head frame 17 mounts therein the components of the power system that pivots the bucket bowls 11 and 12 upon command. The power head frame is divided into a plurality of compartments, each compartment mounting therein different components of the power system. As shown in FIG. 1, four compartments 20, 21, 22 and 23 are formed by external side walls 34, internal parallel side walls 35 spaced therefrom and a transverse center plate 37. The internal side walls are connected by a bottom wall 36 and provided with removable end walls 38 to mount therein hydraulic rams 24, 25, 26 and 27, respectively. The rams 24 and 25 are pivotted at one of their ends to their respective compartments of the head frame 17 and at their other ends to blade arms 13 of the bucket bowls 11 and 12. Pivot pins 30 pivotally connect head frame ends of the rams while pins 31 connect clevises 32, 33 of the rams 24, 25 to the blade arms 13. In a similar manner, the hydraulic rams 26, 27 are connected at one end to the head frame 17 by the pins **30*a* while their other ends are pivotally connected to the blade arms 14 of the buckets 11 and 12 by pins 31*a* pivotally connected to clevises 32*a*, 33*a*. It can, therefore, be seen that when the hydraulic rams 24, 25, 26, and 27 are moved to their greatest extension, the bucket bowls 11 and 12 will pivot counterclockwise and clockwise, respectively, to their closed, engaging position, as shown in FIG. 1. When the hydraulic rams are reciprocated to their least extended position, the bucket bowls 11 and 12** will pivot clockwise and counterclockwise, respectively, to their fully open position (as shown in dotted lines in FIG. 3), where they are ready to be pressed into the material desired to be conveyed and receive the material therein upon subsequent closing of the bucket bowls to their closed engaging position.

The use of two pairs of hydraulic rams are of advantage because they exert balanced forces on the bucket bowls so that undue stresses and consequent unoptimal operation of the bucket bowls does not ensue. To insure this balanced force, the compartments 20, 21, 22, and 23 housing the hydraulic rams are symmetrical about the center plate 37 of the power head frame 17.

The hydraulic rams are actuated by an electric motor 40 and a pump 41 housed in the power head frame 17. The electric motor 40 is positioned in a compartment 42, while the pump 41 is housed in a compartment 43. The compartments 42 and 43 are formed by intermediate side walls 35 and the center plate 37 and may be provided with removable cover secured to the intermediate side walls 35. The electric motor and the pump are symmetrically positioned relative to the center plate 37 and the side walls 35 so that complete balance of forces is achieved. The pump 41 is in fluid communication with a source of hydraulic fluid contained in a tank 46 housed between the end wall 38 and the center wall 37 in compartment 42 of the power head frame. The tank 46 is contained in the compartment 42 that also houses the electric motor 40, while a flow divider 50 are hydraulic valve 51 are housed in the compartment 42 and 43, respectively. The flow divider 50 and a hydraulic valve 51 are mounted on the center plate 37 and positioned symmetrical about the center line of the plate 37 to also provide for symmetrically acting forces. It can, therefore, be seen that the power head frame 17 is divided into six compartments that symmetrically house the power components driving the bucket bowls 11 and 12.

Since the bucket arrangement of the invention is self-powered, and since all of the power components are housed in one frame, maintenance of the device is assured in an easy and cheap way. As shown in FIG. 1, the end walls 38 and the top cover of the power head frame 17 are removable by any convenient method to allow access to the power components in case of replacement or repair. If, for example, access to the pump 41 is desired, the top cover and the end wall nearest to the pump is removed and access to the pump is readily available. Also, since the power components are all housed within compartments in the power head frame 17 and since this compartment arrangement allows the symmetrical mounting of the various components, a balanced force will act on the bucket bowls 11 and 12 at all times thereby preventing undue stress and wear on one of the bucket bowls.

Figure 4:
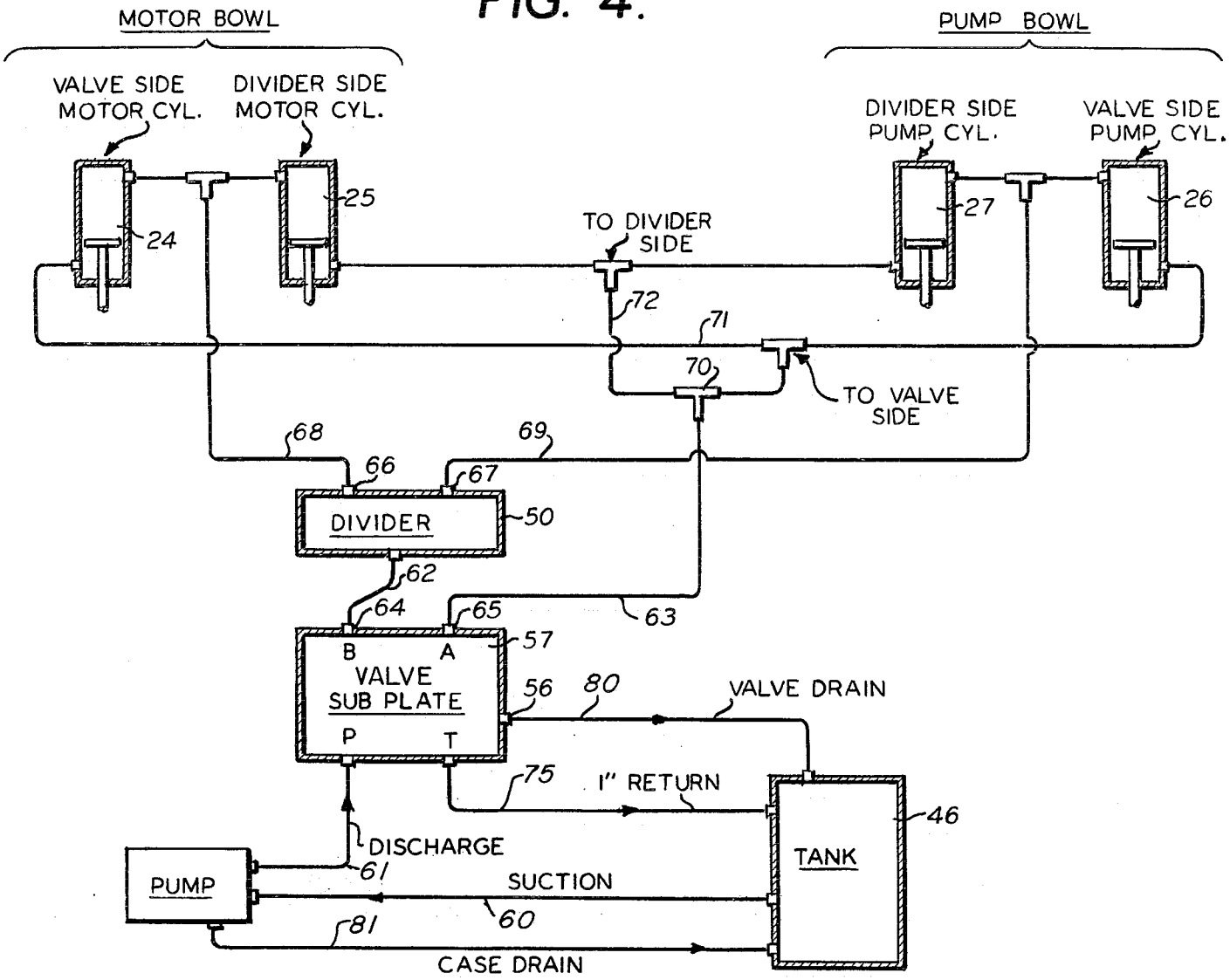
FIG. 4 is a schematic view of the hydraulic control circuit of the bucket arrangement of FIGS. 1, 2 and 3.

FIG. 4 shows, in schematic form, the hydraulic circuit for operating the hydraulic rams 20, 21, 22 and 23. The pump 41, upon actuation of the motor 40, will pump the hydraulic fluid from the tank 46 through the line 60 to the inlet 56 of a manifold subplate 57 via discharge line 61. The subplate or valve 57 will apportion the hydraulic fluid to exit lines 62, 63 through exits 64 and 65. Exit line 62 leads to the inlet of the divider 50 which divides the fluid flow between the motor-side lines 66 and the pump-side line 67. The hydraulic fluid then flows to the lines 68 and 69 causing the hydraulic rams to extend to their greatest distance and thereby pivot and bucket bowls 11 and 12 to their closed, engaging position.

The line 63 delivers the hydraulic fluid to the opposite side of the rams to thereby open the bucket bowls 11 and 12. The line 63 delivers the hydraulic fluid first to the divider line 70 opening into a line 71 which is connected to the opposite sides of the hydraulic rams 26 and 24 as the lines 68 and 69 and secondly to a line 72 connected to the opposite sides of the hydraulic rams 27 and 25 as the lines 68 and 69.

The subplate, or valve, 57 determines which path the hydraulic fluid will follow so as to open and close the hydraulic rams. Whichever position the valve 57 is in, a return line 75 will connect those lines to the tank that are not being supplied by the pump 41 with hydraulic fluid. For example, assuming that the hydraulic rams are in their closed position, as shown in FIG. 4, hydraulic fluid will be stored in the lines 61, 62, 66, 67, 68, and 69. When it is desired to open the bucket bowls 11 and 12, for example, to receive material therein, the valve 57 will be positioned so that conduit 61 is in fluid communication with the conduit 63. When this shifting of the valve occurs, the conduit 62 will be in fluid communication with the return line 75 to thereby allow the hydralic fluid contained in the lines 68, 69, 66, 67 and 62 to return to the tank 46, while at the same time allowing the pump 41 to pump the hydraulic fluid from the tank to the other sides of the hydraulic rams via lines 61, 63, 70, 71, and 72, thereby opening the bucket bowls for the reception of material therein.

The hydraulic control circuit also contains a valve drain 80 and a case drain 81.

While specific embodiment of the invention has been shown and described, it is to be understood that numerous changes and modifications may be made without departing from the scope and spirit of the invention For example, the divider 50 and control valve 57 need not be mounted in the same compartment but may be mounted in separate compartments, for example compartments 42 and 43, respectively.

What is claimed is:

1. A self-powered bucket arrangement comprising a first bucket bowl and a second bucket bowl, and a power head frame pivotally mounting said first and second bowls for pivoting to an open position for the reception of material therein and to a closed position for transporting the material to a desired site, said power head frame having a first and a second exterior parallel side walls, a first and a second intermediate side walls parallel to and spaced from said exterior side walls, a bottom wall integrally connecting said intermediate side walls, and a transversely extending center plate integrally connected to each of said exterior and intermediate side walls along the upper edge thereof, said center plate dividing said power head frame into a first and second longitudinal half, said first and second bucket bowls being pivotally connected respectively to the first and second longitudinal halves, each of said longitudinal halves having a plurality of compartments at least one compartment being defined by said first exterior side wall, said center plate and said first intermediate side wall, at least one compartment being defined by said second exterior side wall, said center plate and second intermediate side wall and at least one compartment being defined by said first and second intermediate side walls, said bottom wall and said center plate, a first and a second pair of hydraulic rams positioned respectively in said first and second longitudinal halves one hydraulic ram of each of said pairs being located in the compartment formed between the first exterior and intermediate side walls and the other hydraulic ram of each of said pairs being located between the second exterior and intermediate side walls, each of said first pair of hydraulic rams having a first end pivotally connected to said center plate and a second end pivotally connected to said first bucket bowl, each of said second pair of hydraulic rams having a first end pivotally connected to said center plate and a second end pivotally connected to said second bucket bowl, and a plurality of power components housed in the remaining compartments of said power head frame.

2. The self-powered bucket arrangement according to claim 1, wherein said power head frame includes a first and a second end wall, and a top cover plate said end walls and cover plate being removably secured to said interior side walls.

3. The self-powered bucket arrangement according to claim 1, wherein said power head frame comprises six compartments, a first compartment formed by said first side wall, one side of said center plate, and said first intermediate side wall, a second compartment formed by said first side wall, the other side of said center plate, and said second intermediate side wall, a third compartment formed by said first and said second intermediate side walls and said one side of said center plate, a fourth compartment formed by said first and second second intermediate side walls and said other side of said center plate, a fifth compartment formed by said second side wall, said second intermediate side wall, and said one side of said center plate, and a sixth compartment formed by said second side wall, said second intermediate side wall, and said other side wall of said center plate.

4. The self-powered bucket arrangement according to claim 3, wherein said plurality of power components comprises an electric motor mounted in said fourth compartment, a hydraulic pump mounted in said third compartment and drivingly connected to said electric motor, a hydraulic valve mounted in said fourth compartment and in fluid communication with said pump, and a fluid divider mounted in said fourth compartment and in fluid communication with said hydraulic valve.

5. The self-powered bucket arrangement according to claim 1, wherein said plurality of power components comprises an electric motor, a hydraulic pump, driven by said electric motor, a tank for supplying hydraulic fluid to said pump, a hydraulic valve for controlling the flow of hydraulic fluid to said pairs of hydraulic rams, said hydraulic rams comprising a double acting cylinder and piston, a fluid divider having an inlet in fluid communication with said hydraulic valve and a pair of outlets, one of said outlets being in fluid communication with one end of each cylinder in said first pair of hydraulic rams and the other outlet being in fluid communication with the opposite end of each cylinder in the second pair of hydraulic rams, and return means leading from the ends of each of the hydraulic cylinders, not connected to the divider, to said hydraulic valve.

6. The self-powered bucket arrangement according to claim 5, wherein said pump is in fluid communication with said tank, said hydraulic valve having an inlet opening, a pair of outlet openings, and a return opening, said pump being in fluid communication with said inlet opening of said hydraulic valve.

7. The self-powered bucket arrangement according to claim 6, wherein one of said outlet openings is in fluid communication with one of the ends of said hydraulic rams, and the other of said outlet openings is in fluid communication with the other ends of said hydraulic rams.

8. The self-powered bucket arrangement according to claim 1, wherein each of said bowls comprise a pair of polygonal side walls, a rear wall and a bottom wall, each of said side walls having integrally attached thereto a blade arm extending upwardly from its upper edge and includes bearing means for pivotal attachment to said exterior and intermediate side walls of the associated compartments and bearing means for pivotal attachment to the associated ends of said hydraulic rams.

9. The self-powered bucket arrangement of claim 8 wherein said blade arms are so dimensioned that the bowls are suspended below the bottom edge of exterior and intermediate side walls, in the closed position and said blade arms are recessed within said compartments in said open position.

* * * * *